US006024659A

United States Patent [19]

Reed

[11] Patent Number: 6,024,659

[45] Date of Patent: Feb. 15, 2000

[54] GOALPOST UPRIGHT EXTENSION

[76] Inventor: Ronald R. Reed, 2835 Sunnybrook Rd., Mogadore, Ohio 44260

[21] Appl. No.: 09/146,496

[22] Filed: Sep. 3, 1998

[51] Int. Cl.[7] ..... A63B 67/00

[52] U.S. Cl. ..... 473/477

[58] Field of Search ..... 473/477, FOR 128, 473/FOR 212, FOR 124, 415, 438, 476, 479, 478, 492

[56] References Cited

U.S. PATENT DOCUMENTS

| | | |
|---|---|---|
| D. 250,283 | 11/1978 | Norton . |
| 2,074,125 | 3/1937 | Lefft . |
| 2,845,269 | 7/1958 | Simmons . |
| 2,929,630 | 3/1960 | Simmons . |
| 3,516,666 | 6/1970 | Trimble . |
| 3,856,302 | 12/1974 | Karkosa . |
| 3,908,992 | 9/1975 | Cunningham . |
| 3,981,501 | 9/1976 | Gonzalez . |
| 4,026,554 | 5/1977 | Karkoska . |
| 5,280,904 | 1/1994 | Rodriguez . |
| 5,372,368 | 12/1994 | Pavonetti . |
| 5,429,350 | 7/1995 | Meier . |

*Primary Examiner*—Sebastiano Passaniti

[57] ABSTRACT

A goalpost upright extension for extending the lengths of an upright of a football goalpost. The extension includes a tubular elongate member having an exterior, a lumen, opposite top and bottom ends, and a longitudinal axis extending between the top and bottom ends. The bottom end of elongate member is designed for receiving the upper end of an upright of a goalpost therein such that the upright extends into the lumen of the elongate member and the longitudinal axis of the elongate member extends in a generally vertical direction. The elongate member has a pair of generally coaxial stop holes therethrough between the lumen and the exterior of the elongate member. The stop holes are positioned towards the bottom end of the elongate member. The threaded portion of a stop screw is threadedly extended through the threaded inserts of the stop holes such that the threaded portion of the stop screw extends across the lumen of the elongate member.

13 Claims, 2 Drawing Sheets

GOALPOST UPRIGHT EXTENSION

BACKGROUND OF THE INVENTION

1. Field of the Invention

The present invention relates to goalpost uprights extensions and more particularly pertains to a new goalpost uprights extensions for extending the lengths of the uprights of a football goalpost.

2. Description of the Prior Art

The use of goalpost uprights extensions is known in the prior art. More specifically, goalpost uprights extensions heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,981,501; U.S. Pat. No. 4,026,554; U.S. Pat. No. 5,429,350; U.S. Pat. No. 5,372,368; U.S. Pat. No. Des. 250,283; and U.S. Pat. No. 5,280,904.

While these devices fulfill their respective, particular objectives and requirements, the aforementioned patents do not disclose a new goalpost uprights extensions. The inventive device includes a tubular elongate member having an exterior, a lumen, opposite top and bottom ends, and a longitudinal axis extending between the top and bottom ends. The bottom end of elongate member is designed for receiving the upper end of an upright of a goalpost therein such that the upright extends into the lumen of the elongate member and the longitudinal axis of the elongate member extends in a generally vertical direction. The elongate member has a pair of generally coaxial stop holes therethrough between the lumen and the exterior of the elongate member. The stop holes are positioned towards the bottom end of the elongate member. The threaded portion of a stop screw is threadedly extended through the threaded inserts of the stop holes such that the threaded portion of the stop screw extends across the lumen of the elongate member.

In these respects, the goalpost uprights extensions according to the present invention substantially departs from the conventional concepts and designs of the prior art, and in so doing provides an apparatus primarily developed for the purpose of extending the lengths of the uprights of a football goalpost.

SUMMARY OF THE INVENTION

In view of the foregoing disadvantages inherent in the known types of goalpost uprights extensions now present in the prior art, the present invention provides a new goalpost uprights extensions construction wherein the same can be utilized for extending the lengths of the uprights of a football goalpost.

The general purpose of the present invention, which will be described subsequently in greater detail, is to provide a new goalpost uprights extensions apparatus and method which has many of the advantages of the goalpost uprights extensions mentioned heretofore and many novel features that result in a new goalpost uprights extensions which is not anticipated, rendered obvious, suggested, or even implied by any of the prior art goalpost uprights extensions, either alone or in any combination thereof.

To attain this, the present invention generally comprises a tubular elongate member having an exterior, a lumen, opposite top and bottom ends, and a longitudinal axis extending between the top and bottom ends. The bottom end of elongate member is designed for receiving the upper end of an upright of a goalpost therein such that the upright extends into the lumen of the elongate member and the longitudinal axis of the elongate member extends in a generally vertical direction. The elongate member has a pair of generally coaxial stop holes therethrough between the lumen and the exterior of the elongate member. The stop holes are positioned towards the bottom end of the elongate member. The threaded portion of a stop screw is threadedly extended through the threaded inserts of the stop holes such that the threaded portion of the stop screw extends across the lumen of the elongate member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new goalpost uprights extensions apparatus and method which has many of the advantages of the goalpost uprights extensions mentioned heretofore and many novel features that result in a new goalpost uprights extensions which is not anticipated, rendered obvious, suggested, or even implied by any of the prior art goalpost uprights extensions, either alone or in any combination thereof.

It is another object of the present invention to provide a new goalpost uprights extensions which may be easily and efficiently manufactured and marketed.

It is a further object of the present invention to provide a new goalpost uprights extensions which is of a durable and reliable construction.

An even further object of the present invention is to provide a new goalpost uprights extensions which is susceptible of a low cost of manufacture with regard to both materials and labor, and which accordingly is then susceptible of low prices of sale to the consuming public, thereby making such goalpost uprights extensions economically available to the buying public.

Still yet another object of the present invention is to provide a new goalpost uprights extensions which provides in the apparatuses and methods of the prior art some of the advantages thereof, while simultaneously overcoming some of the disadvantages normally associated therewith.

Still another object of the present invention is to provide a new goalpost uprights extensions for extending the lengths of the uprights of a football goalpost.

Yet another object of the present invention is to provide a new goalpost uprights extensions which includes a tubular elongate member having an exterior, a lumen, opposite top and bottom ends, and a longitudinal axis extending between the top and bottom ends. The bottom end of elongate member is designed for receiving the upper end of an upright of a goalpost therein such that the upright extends into the lumen of the elongate member and the longitudinal axis of the elongate member extends in a generally vertical direction. The elongate member has a pair of generally coaxial stop holes therethrough between the lumen and the exterior of the elongate member. The stop holes are positioned towards the bottom end of the elongate member. The threaded portion of a stop screw is threadedly extended through the threaded inserts of the stop holes such that the threaded portion of the stop screw extends across the lumen of the elongate member.

Still yet another object of the present invention is to provide a new goalpost uprights extensions that makes it easier to determine whether a kick is good or no good when a team attempts to score a field goal or an extra conversion point.

Even still another object of the present invention is to provide a new goalpost uprights extensions that also has directional streamers for indicating which way the wind is blowing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
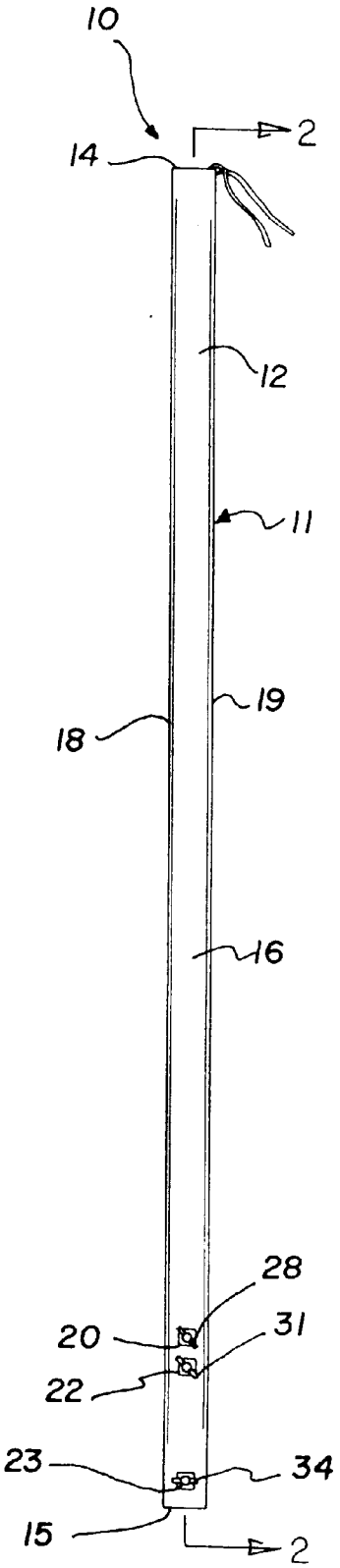
FIG. 1 is a schematic side view of the first side of a new goalpost uprights extensions according to the present invention.
Figure 2:
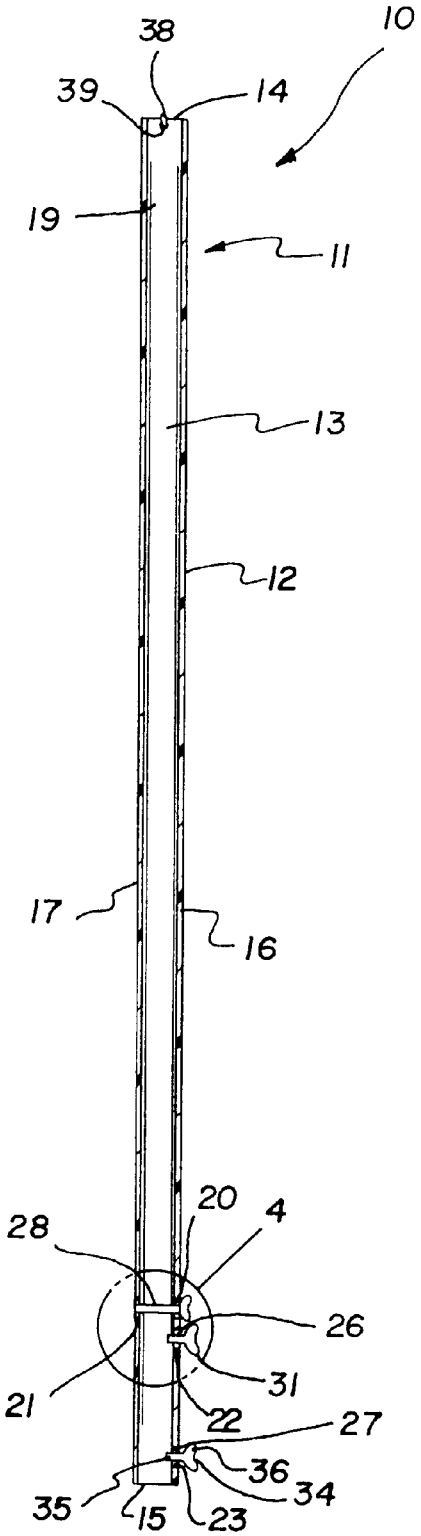
FIG. 2 is a schematic cross sectional view of the present invention taken from line 2—2 of FIG. 1.
Figure 3:
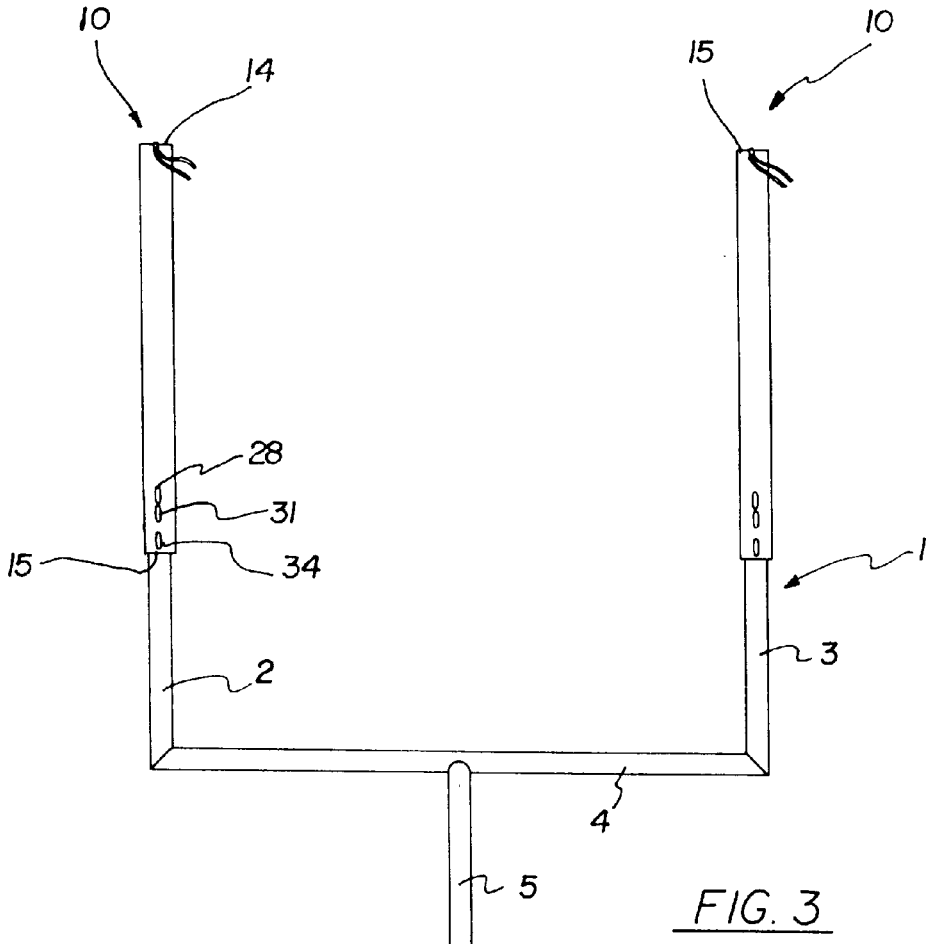
FIG. 3 is a schematic side view of the back side of a goalpost having a pair of the present invention on its uprights.
Figure 4:
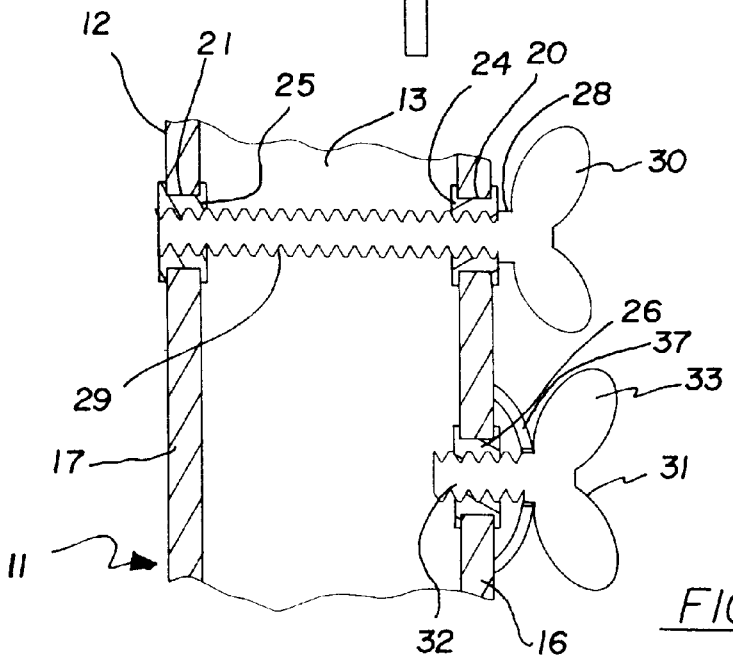
FIG. 4 is a schematic partial cross sectional view of the present invention taken from the circular 4 on FIG. 2.

With reference now to the drawings, and in particular to FIGS. 1 through 4 thereof, a new goalpost upright extension embodying the principles and concepts of the present invention and generally designated by the reference numeral 10 will be described.

As best illustrated in FIGS. 1 through 4, the goalpost upright extension 10 generally comprises a tubular elongate member 11 having an exterior 12, a lumen 13, opposite top and bottom ends 14,15, and a longitudinal axis extending between the top and bottom ends 14,15. The bottom end 15 of elongate member 11 is designed for receiving the upper end of an upright 2 of a goalpost 1 therein such that the upright 2 extends into the lumen 13 of the elongate member 11 and the longitudinal axis of the elongate member 11 extends in a generally vertical direction. The elongate member 11 has a pair of generally coaxial stop holes 20,21 therethrough between the lumen 13 and the exterior 12 of the elongate member 11. The stop holes 20,21 are positioned towards the bottom end 15 of the elongate member 11. The threaded portion 29 of a stop screw 28 is threadedly extended through the threaded inserts 24,25 of the stop holes 20,21 such that the threaded portion 29 of the stop screw 28 extends across the lumen 13 of the elongate member 11.

The extension is designed for use in a pair for extending the lengths of a pair of uprights 2,3 of a football goalpost 1 also having a crossbar 4, and a main standard 5. Specifically, each extension 10 comprises a tubular elongate member 11 having an exterior 12, a lumen 13, opposite open top and bottom ends 14,15, and a longitudinal axis extending between the top and bottom ends 14,15. Ideally, the elongate member 11 comprises a generally rigid PVC material for providing strong and light weight elongate member 11. The elongate member 11 preferably has a generally rectangular configuration and has a generally rectangular cross section generally perpendicular to the longitudinal axis of the elongate member 11 and four sides 16,17,18,19. The four sides of the elongate member 11 including first and second sides 16,17 lying in generally parallel planes to one another and third and fourth sides 18,19 lying in generally parallel planes to one another and generally perpendicular to the planes of the first and second sides 16,17.

The elongate member 11 has a length defined between the top and bottom ends 14,15 of the elongate member 1, a width defined between the first and second sides 16,17, a depth defined between the third and fourth sides 18,19, and a thickness defined between the lumen 13 and the exterior 12. Ideally, the four sides of the elongate member 11 are of generally equal dimensions such that the cross section of the elongate member 11 is generally square such that the width and depth of the elongate member 11 are generally equal to one another. Preferably, the length of the elongate member 11 is greater than about 9 feet, the width of the elongate member 11 is greater than about 2 inches, the depth of the elongate member 11 is greater than about 2 inches, and the thickness of the elongate member 11 is greater than about ½ inch. In an ideal illustrative embodiment, the length of the elongate member 11 is about 18 feet, the width of the elongate member 11 is about 5 inches, the depth of the elongate member 11 is about 5 inches, and the thickness of the elongate member 11 is about 1 inch.

Optionally, the elongate member 11 may generally cylindrical and have inner and outer diameters generally perpendicular to the longitudinal axis of the elongate member 11. The lumen 13 defines the inner diameter while the exterior 12 of the elongate member 11 defines the outer diameter. Preferably, the inner diameter is greater than about 2 inches, and the outer diameter is greater than about 3 inches. In an ideal illustrative embodiment of this optional configuration, the inner diameter is about 4 inches and the outer diameter is about 5 inches.

In use, the opening of the bottom end 15 of elongate member 11 is designed for receiving the upper end of an upright 2 of a goalpost 1 therein such that the upright 2 extends into the lumen 13 of the elongate member 11 and the longitudinal axis of the elongate member 11 extends in a generally vertical direction.

The elongate member 11 has a pair of generally coaxial stop holes 20,21 therethrough between the lumen 13 and the exterior 12 of the elongate member 11. The stop holes 20,21 are positioned closer towards the bottom end 15 of the elongate member 11 than towards the top end 14 of the elongate member 11. Each of the stop holes 20,21 has a center defining an axis extending generally perpendicular to the longitudinal axis of the elongate member 11. The axis of the of the stop holes 20,21 is spaced apart from the bottom end 15 of the elongate member 11 a distance greater than about 12 inches. Ideally, the distance between the axis of the stop holes 20,21 and the bottom end 15 of the elongate member 11 is about 24 inches. One of the stop holes is located on the first side 16 of the elongate member 11 and the other stop hole is located on the third side 18 of the elongate member 11.

The elongate member 11 also has spaced apart first and second set holes 22,23 therethrough between the lumen 13 and the exterior 12 of the elongate member 11. The first and second set holes 22,23 are positioned between the one stop hole 20 and the bottom end 15 of the elongate member 11. Preferably, the first and second set holes 22,23 are located on the first side 16 of the elongate member 11. Even more preferably, each of the first and second set holes 22,23 has a center which with the one stop hole on the first side 16 of the elongate member define a line extending generally parallel to the longitudinal axis of the elongate member 11. Each of the stop holes 20,21 and the set holes has threaded insert 24,25,26,27 provided therein with a threaded bore.

A stop screw 28 is provided having threaded portion 29 and a winged turning head portion 30. The threaded portion 29 of the stop screw 28 is threadedly extended through the threaded inserts 24,25 of the stop holes 20,21 such that the threaded portion 29 of the stop screw 28 extends across the lumen 13 of the elongate member 11. The turning head portion 30 of the stop screw 28 is located adjacent the one stop hole on the first side 16 of the elongate member 11. In use, the stop screw 28 is designed for resting on an upper end of the upright 2 to prevent extension of the upright 2 in the lumen 13 of the elongate member 11 beyond the stop screw 28.

First and second set screws 31,34 are also provided each having a threaded portion 32,35 and a winged turning head portion 33,36. The threaded portion 32 of the first set screw 31 is threadedly extended through the threaded insert 26 of the first set hole 22 with the turning head portion 33 of the first set screw 31 located adjacent the first side 16 of the elongate member 11. The threaded portion 35 of the second set screw 34 is threadedly extended through the threaded insert 27 of the second set hole 23 with the turning head portion 36 of the second set screw 34 located adjacent the first side 16 of the elongate member 11. Each of the set screws 31,34 preferably has a locking washer 37 disposed thereon between the head portion 33,36 and the exterior 12 of the elongate member 11 to help the set screws 31,34 stay tight against the upright 2. In use, the first and second set screws 31,34 are designed for tightening against the upright 2 in the lumen 13 of the elongate member 11 to hold the elongate member 11 to the upright 2.

A plurality of flexible directional streamers 38 are coupled to the top end 14 of the elongate member 11. The directional streamers 38 are designed for blowing in the wind to indicate the direction of the wind. Preferably, the elongate member 11 has an upper hole 39 therethrough between the lumen 13 and exterior 12 of the elongate member 11. The upper hole 39 is positioned adjacent the top end 14 of the elongate member 11. The upper hole 39 is preferably located on the first side 16 of the elongate member 11. The directional streamers 38 are looped through the upper hole 39 and tied together to couple the directional streamers 38 to the top end 14 of the elongate member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An extension for extending the lengths of an upright of a football goalpost, said extension comprising:

a tubular elongate member having an exterior, a lumen, opposite top and bottom ends, and a longitudinal axis extending between said top and bottom ends;

said bottom end of elongate member being adapted for receiving the upper end of an upright of a goalpost therein such that the upright extends into said lumen of said elongate member and said longitudinal axis of said elongate member extends in a generally vertical direction;

said elongate member having a pair of generally coaxial stop holes therethrough between said lumen and said exterior of said elongate member, said stop holes being positioned towards said bottom end of said elongate member; and a stop screw having threaded portion and a turning head portion, said threaded portion of said stop screw being threadedly extended through said stop holes such that said threaded portion of said stop screw extends across the lumen of said elongate member.

2. The extension of claim 1, wherein said elongate member has a generally rectangular configuration and having a generally rectangular cross section generally perpendicular to said longitudinal axis of said elongate member and four sides.

3. The extension of claim 2, wherein said four sides of said elongate member include first and second sides lying in generally parallel planes to one another, said four sides including third and fourth sides lying in generally parallel planes to one another and generally perpendicular to the planes of said first and second sides.

4. The extension of claim 3, wherein said elongate member has a length defined between said top and bottom ends of said elongate member, a width defined between said first and second sides, a depth defined between said third and fourth sides, and a thickness defined between said lumen and said exterior.

5. The extension of claim 3, wherein said four sides of said elongate member are of generally equal dimensions such that said cross section of said elongate member is generally square such that said width and depth of said elongate member are generally equal to one another.

6. The extension of claim 4, wherein said length of said elongate member is greater than about 9 feet, said width of said elongate member is greater than about 2 inches, said depth of said elongate member is greater than about 2 inches, and said thickness of said elongate member is greater than about ½ inch.

7. The extension of claim 4, wherein said length of said elongate member is about 18 feet, said width of said elongate member is about 5 inches, said depth of said elongate member is about 5 inches, and said thickness of said elongate member is about 1 inch.

8. The elongate member of claim 1, wherein said elongate member is generally cylindrical and having inner and outer diameters generally perpendicular to said longitudinal axis of said elongate member, said lumen defining said inner diameter, said exterior of said elongate member defining said outer diameter.

9. The elongate member of claim 8, wherein said inner diameter is greater than about 2 inches, and said outer diameter is greater than about 3 inches.

10. The elongate member of claim 8, wherein said inner diameter is about 4 inches, wherein said outer diameter is about 5 inches.

11. The elongate member of claim 1, further comprising first and second set screws having threaded portion and a turning head portion, wherein said elongate member has spaced apart first and second set holes therethrough between said lumen and said exterior of said elongate member, said first and second set holes being positioned between said one stop hole and said bottom end of said elongate member, and wherein said threaded portion of said first set screw is threadedly extended through said threaded insert of said first set hole, and wherein said threaded portion of said second set screw is threadedly extended through said threaded insert of said second set hole.

12. The elongate member of claim 1, further comprising a plurality of flexible directional streamers being coupled to said top end of said elongate member.

13. An extension for extending the length of an upright of a football goalpost, said extension comprising:

an elongate member being generally tubular and having an exterior, a lumen, opposite top and bottom ends, and a longitudinal axis extending between said top and bottom ends, said top and bottom ends of said elongate member each having an opening into the lumen of said elongate member;

said elongate member having a generally rectangular configuration and having a generally rectangular cross section generally perpendicular to said longitudinal axis of said elongate member and four sides;

said four sides of said elongate member including first and second sides lying in generally parallel planes to one another, said four sides including third and fourth sides lying in generally parallel planes to one another and generally perpendicular to the planes of said first and second sides;

said elongate member having a length defined between said top and bottom ends of said elongate member, a width defined between said first and second sides, a depth defined between said third and fourth sides, and a thickness defined between said lumen and said exterior;

wherein said length of said elongate member is about 18 feet, said width of said elongate member is about 5 inches, said depth of said elongate member is about 5 inches, and said thickness of said elongate member is about 1 inch;

said opening of said bottom end of elongate member being adapted for receiving the upper end of an upright of a goalpost therein such that the upright extends into said lumen of said elongate member and said longitudinal axis of said elongate member extends in a generally vertical direction;

said elongate member having a pair of generally coaxial stop holes therethrough between said lumen and said exterior of said elongate member, said stop holes being positioned towards said bottom end of said elongate member, each of said stop holes having a center defining an axis extending generally perpendicular to said longitudinal axis of said elongate member;

said axis of said of said stop holes being spaced apart from said bottom end of said elongate member a distance greater than about 12 inches, wherein said distance between said axis of said stop holes and said bottom end of said elongate member is about 24 inches;

one of said stop holes being located on said first side of said elongate member, the other of said stop holes being located on said third side of said elongate member;

said elongate member having spaced apart first and second set holes therethrough between said lumen and said exterior of said elongate member, said first and second set holes being positioned between said one stop hole and said bottom end of said elongate member;

said first and second set holes being located on said first side of said elongate member;

said first and second set holes each having a center, said centers of said set holes and said one stop hole defining a line extending generally parallel to said longitudinal axis of said elongate member;

each of said stop holes and said set holes having threaded insert provided therein;

a stop screw having threaded portion and a turning head portion, said threaded portion of said stop screw being threadedly extended through said threaded inserts of said stop holes such that said threaded portion of said stop screw extends across the lumen of said elongate member, said turning head portion of said stop screw being located adjacent said one stop hole on said first side of said elongate member;

first and second set screws having threaded portion and a turning head portion, said threaded portion of said first set screw being threadedly extended through said threaded insert of said first set hole, said turning head portion of said first screw being located adjacent said first side of said elongate member;

said threaded portion of said second set screw being threadedly extended through said threaded insert of said second set hole, said turning head portion of said second screw being located adjacent said first side of said elongate member;

each of said set screws having a locking washer disposed thereon between said head portion and said exterior of said elongate member; and a plurality of flexible directional streamers being coupled to said top end of said elongate member.

* * * * *